US007097075B2

(12) United States Patent
Peuker et al.

(10) Patent No.: US 7,097,075 B2
(45) Date of Patent: Aug. 29, 2006

(54) DEVICE FOR STORING AND DISPENSING FLOWABLE COMPOSITIONS

(75) Inventors: Marc Peuker, Seefeld (DE); Martin Hartung, Munich (DE); Dirk Mueller, Munich (DE); Roland Brem, Mering (DE)

(73) Assignee: 3M Espe AG, Seefeld (DE)

( * ) Notice: Subject to any disclaimer, the term of this patent is extended or adjusted under 35 U.S.C. 154(b) by 389 days.

(21) Appl. No.: 10/416,544

(22) PCT Filed: Nov. 7, 2001

(86) PCT No.: PCT/EP01/12865

§ 371 (c)(1),
(2), (4) Date: Sep. 25, 2003

(87) PCT Pub. No.: WO02/38468

PCT Pub. Date: May 16, 2002

(65) Prior Publication Data

US 2004/0065679 A1 Apr. 8, 2004

(30) Foreign Application Priority Data

Nov. 13, 2000 (DE) ..... 100 56 212

(51) Int. Cl.
*B65D 81/32* (2006.01)

(52) U.S. Cl. ..... 222/94; 222/145.1; 222/145.5; 206/221

(58) Field of Classification Search ..... 222/94, 222/145.1, 145.5; 206/219, 221

See application file for complete search history.

(56) References Cited

U.S. PATENT DOCUMENTS

| | | | | |
|---|---|---|---|---|
| 2,176,923 | A * | 10/1939 | Nitardy | 222/94 |
| 3,145,838 | A | 8/1964 | Van Deusen | |
| 3,257,072 | A * | 6/1966 | Reynolds | 494/10 |
| 3,542,032 | A * | 11/1970 | Spencer, Jr. | 607/114 |
| 5,114,004 | A * | 5/1992 | Isono et al. | 206/222 |
| 5,209,347 | A * | 5/1993 | Fabisiewicz et al. | 206/219 |
| 6,105,761 | A * | 8/2000 | Peuker et al. | 206/229 |

FOREIGN PATENT DOCUMENTS

| | | |
|---|---|---|
| DE | 199 62 436 A | 7/2001 |
| EP | 0 895 943 A | 2/1999 |
| JP | 2-86177 | 4/1982 |
| JP | 58-116584 | 11/1983 |

(Continued)

OTHER PUBLICATIONS

International Search Report of corresponding PCT Application No. PCT/EP01/12865.

(Continued)

*Primary Examiner*—J. Casimer Jacyna
(74) *Attorney, Agent, or Firm*—Crowell & Moring LLP

(57) ABSTRACT

The invention relates to a device for storing and dispensing a flowable composition. Said device comprises a first (1) and a second film (2), a dispensing zone (4), a first chamber (5), containing a first substance (A) and a second chamber (6), containing a second substance (B). Said chambers are interconnected by a transition zone (3) that can be selectively opened. At least one of the films is deep-drawn in the region of the chambers and at least one of the films is pre-formed in the region of the second chamber, in such a way that once the device has been activated by opening the transition zone, the first substance can to a great extent be completely transferred to a second chamber, increasing the volume of said chamber as a result.

36 Claims, 1 Drawing Sheet

FOREIGN PATENT DOCUMENTS

| | | |
|---|---|---|
| JP | 7-300161 | 11/1995 |
| JP | 10-120040 | 5/1998 |
| JP | 11-292154 | 10/1999 |
| WO | WO00 09415 A | 2/2000 |

OTHER PUBLICATIONS

Translation of Japanese Office Action dated Oct. 14, 2005 (Two (2) pages).

* cited by examiner

= state on delivery
= activated state

DEVICE FOR STORING AND DISPENSING FLOWABLE COMPOSITIONS

BACKGROUND AND SUMMARY OF THE INVENTION

The invention relates to a device for storing and dispensing a composition of least two components which is capable of flowing after mixing.

Small amounts of liquid can be stored and dispensed in receptacles in the form of blister packs. In the thermoformed part of the pack closed off by a removable film there are formed, for example, two recesses which are separate from each other. The first recess may contain a small amount of liquid, and a brush may be placed in the other recess.

International Patent Document WO-96/03326 describes, for example, a disposable receptacle which has depressions for storing a medicament and an applicator. Both depressions are protected from contamination by means of a peelable covering film. In one embodiment, by pressing on the depression containing the medicament, said medicament is transferred into the depression containing the applicator in order to wet the applicator. It is explained that this is possible only when the covering film is not bonded to the receptacle in the transition zone between the two depressions.

U.S. Pat. No. 3,835,834 discloses a treatment kit which has two depressions in a main body, which contain a care substance on the one hand and a swab on the other hand. The main body containing the care substance and the swab is protected from contamination by means of a sealing film.

European Patent Document EP 0 895 943 A discloses a device for storing and dispensing a flowable substance, with a container made up of two films which are connected to each other to form two chambers for receiving substances and a pocket which is separate from the chambers and is used for removing the mixture of the two substances. The separation between one chamber and the pocket has a transition zone that can be selectively opened. For activating the device, first pressure is exerted on one chamber, whereby the substance located in it is transferred into the second chamber via the transition zone. As a result, a positive pressure builds up in the second chamber and leads to bulging of one of the films forming the chambers. To prevent the mixture from flowing back into the first chamber, it is necessary for the device to be bent in the zone between the two chambers. This does not eliminate the possibility of operator errors.

It is consequently a disadvantage of the devices known from the prior art that they are only suitable with reservations for dispensing homogeneous compositions which can be obtained by mixing two substances stored separately in the device. In particular, in the case of compositions with different volumes or states of aggregation of their individual constituents, a homogeneous and reproducible mixing result often cannot be ensured.

The prime object of the present invention is to provide an improved device for storing and dispensing mixtures.

A further object can be regarded as that of providing a device which makes it possible for even relatively large amounts of substance to be stored and dispensed without impairing the mixing result.

A further object can be regarded as that of providing a multi-chamber device which to a great extent prevents the mixture to be dispensed from flowing back into one of the chambers of the device during dispensing.

These objects are achieved by providing a device such as that described in the claims.

The terms "comprise" or "include" introduce a list of features which is not considered to be exhaustive. The fact that the word "a" is used in the claims before stating a feature does not exclude the possibility that the features stated may be present as a plurality, in the sense of "at least one".

The device makes it possible to store, mix and dispense flowable compositions of which the individual constituents can be stored separately from one another in the device before mixing. The device is activated by pressure being exerted on the first chamber, whereby the substance located in this chamber is transferred into the second chamber via the transition zone that can be selectively opened. The transition zone that can be selectively opened consequently represents, as it were, a kind of predetermined breaking point.

The mixing of the two substances takes place in the second chamber, in which the second substance is located.

If, by reason of its volume, the second chamber cannot receive the first substance, or only under more difficult conditions, as in the device according to European Patent Document EP 0 895 943 A, only part of the first substance can be mixed with the second substance. This is disadvantageous, since a reproducible mixing result is required, in particular in the medical sector. Mixtures with deviations in the concentration of individual constituents are in many cases unusable.

The present invention solves this problem, since, according to the invention, the second chamber is designed in such a way that it can receive not only a first substance but also a second substance, it being possible for the two substances to be mixed in the device without the device having to be opened beforehand, but opening being possible without any problem after mixing.

This is ensured by the volume of the second chamber constantly allowing itself to increase.

For this purpose, the at least one of the films forming the chambers of the device is pre-formed or plastically deformable in the zone of the second chamber.

The device according to the invention also makes it possible to follow the activation of the device by exerting pressure on the first chamber, in particular visually. The transfer of the first substance from the first chamber into the second chamber brings about a permanent increase in volume of the second chamber, which can be detected from outside during use.

The term "pre-formed" in the sense of the invention is to be understood as meaning a plastic, defined deforming or pre-forming of a film, it being possible for the film to be converted from this form into another form in a controlled and deliberate manner. This includes pre-forming both by peelable sealing with another film and seal-free zones. Pre-forming can be achieved, for example, by thermoforming a film by means of thermoforming molds.

Films in the sense of the invention are deformable, in particular plastically deformable, if, when they are exposed to an external force (for example by an internal pressure building up in a chamber when the device is activated), they yield to this force while deforming, for example by permanent expansion. Suitable films which can be deformed by the activation of the device preferably do not have any appreciable elasticity and consequently have no appreciable recovery.

A film is expandable in the sense of the invention if it can be permanently expanded or deformed by the internal pressure building up when the device is activated.

Since the volume of the second chamber increases only "when required" by activation of the device, the invention makes possible a minimal pack volume for the substances to be stored and to be mixed.

Furthermore, the substances can be filled into the chambers of the device with virtually no inclusion of atmospheric oxygen or other gases in the dead volume, since the additional volume required in the second chamber for mixing is automatically provided when the first substance is transferred from the first chamber into the second chamber.

The creation of a compressed gas cushion (air spring) in the second chamber by the transfer of the first substance from the first chamber into the second chamber, which would force one of the substances back into the first chamber, is consequently prevented to the greatest extent.

A similar effect can be achieved—albeit with high technical expenditure—by filling the device under vacuum. In this case, the volume not filled by the substance (dead volume) during filling is replaced by a vacuum, which after sealing of the device and subsequent exposure of the device to atmospheric pressure leads to corresponding shrinkage of the zones of the volume that are under vacuum. By combining the two possibilities, the dead volume can be reduced virtually completely.

The device is suitable, in particular, for storing, mixing and dispensing substances which are present in the device in different volumes.

To ensure that the substance with the smaller volume takes part substantially completely in the mixing operation and that instances of misapportionment are prevented during mixing, it is expedient to store this substance in the second chamber and to carry out the mixing in this chamber. The substance with the greater volume is in this respect expediently stored in the first chamber. In this way, a reproducible mixing result that is virtually independent of the user is ensured when the substance with the greater volume is transferred from the first chamber into the second chamber.

By bending the device in the zone between the chambers, the transition zone or zones that can be selectively opened can be closed again when required. Flowing back of the mixed substances into the other chamber is then virtually impossible, so that the mixed substances can be transferred into the dispensing zone by pressure being applied to the outer zone of the films forming the second chamber.

The volume of the first chamber usually lies in the range from 0.01 to 100 ml, preferably in the range from 0.05 to 50 ml.

The volume of the second chamber is preferably less than or equal to the volume of the first chamber, at least before the activation of the device, and lies in the range from 0.001 to 100 ml, preferably in the range from 0.01 to 25 ml.

A chamber has, for example, a diameter from 1 to 100 mm, preferably in the range from 5 to 50 mm. The total volume which can be applied usually lies in the range from 0.011 to 200 ml, preferably the range from 0.06 to 75 ml.

To achieve the increase in volume of the second chamber essential for the invention, different embodiments are conceivable.

The increase in volume can be achieved, for example, by a substantially concave formation of the base film and substantially convex formation of the covering film (from the view of the product filled into the chamber). The covering film is for this purpose likewise thermoformed somewhat in the area of the second chamber and connected to the second film in such a way that the thermoformed zone can bulge outward when the device is activated.

To reduce the resistance with which the thermoformed film opposes the pressure building up in the chamber when it is bulging outward, and to ensure a maximum increase in volume, the following method of production has proven to be advantageous:

The covering film is firstly thermoformed and subsequently inverted, so that the indentation in the film is located on the side opposite from the thermoformed mold. The material displacement occurring in the film during thermoforming, and the associated stress, are at least partly retained during the inversion, so that the film is, as it were, in a quasi prestressed state and can consequently be inverted outward more easily upon activation. The covering film produced in this way is finally sealed onto the likewise thermoformed base film. The inverted indentation in the covering film and the indentation in the base film in this case point in the same direction and form between them the volume of the second chamber in the storing state.

The description of the form of a film as "concave" or "convex" does not, however, exclude the possibility of the film changing its curvature characteristics, in particular in edge zones.

It is also conceivable to thermoform only the base film, to be precise in a form which makes it possible for the film to bulge when the device is activated. Such a form can be achieved for example by the initially convexly outward-bulged base film being at least partially pressed in again. This form can, however, also be achieved in a single step by providing a corresponding mold. Consequently, a film which is deformed in a more or less wave-shaped manner in cross section is obtained.

In a variant of this embodiment, the base film has, viewed in cross section, a number of wave peaks and wave valleys, it being possible for the film to be sealed with the covering film in a peelable manner in the area of a wave valley, so that the chamber is subdivided into a number of compartments.

The device is consequently suitable, if appropriate, for storing and mixing more than two substances. The second substance, expediently sealed in a peelable manner in the center of the second chamber, is initially surrounded without direct contact, in a channel-like manner, by the first substance transferred from the first chamber into the second chamber when the device is activated. With increasing pressure on the first chamber and transfer of an increasing amount of second substance, the sealing seam in the area of the wave valley begins to come apart, whereby the first substance begins to wet the second substance.

A further possibility is for the second chamber to be sealed in a peelable manner in an edge zone or the two films forming the chamber to be pressed one onto the other, lying flat, in this zone without sealing them in a peelable manner in this zone. This edge zone is adjoined by a non-peelable sealing zone, which in the end, and in particular, when the device is activated, seals off the chamber from the outside. This non-peelable (firmly sealed) sealing zone is only interrupted by a peelable transition zone at the point at which the second chamber opens into the dispensing zone and the connection between the first chamber and the second chamber is to be established. The increase in volume of the second chamber when the device is activated takes place by the covering film allowing itself to be detached or lifting off from the base film in this area.

It has been found that peelably sealed or unsealed edge zones may have a stronger recovering tendency after the increase in volume brought about by activating the device than films which are converted from a convex form into a concave form upon activation.

An increase in volume of the second chamber can also be achieved, for example, by at least one of the films forming the second chamber being deformable or expandable, in particular, plastically deformable. When the first substance is transferred into the second chamber, in this case the increase in volume takes place by the plastically deformable film allowing itself to expand, preferably without appreciable recovery.

The possibilities stated above can of course also be combined with one another.

The width of the peelably sealed edge zone can in principle be any width desired and depends on the desired increase in volume. A width in the range from 0.1 to 40 mm, preferably from 0.5 to 20 mm, has proven successful.

The zones that can be selectively opened, or the peelably sealed zones, preferably open when a hydrostatic pressure in the range from 3 to 300 $N/cm^2$, particularly preferably in the range from 15 to 150 $N/cm^2$, is exerted by a flowable substance on this zone. The pressure to be applied for opening the zones that can be selectively opened may vary for each zone that can be selectively opened, depending on the embodiment. This makes possible a directed transfer of the substances to be mixed into the respective chambers as far as the dispensing zone.

Depending on the embodiment and films used, slight changes in geometry of the device may occur, in particular, in the area of the second chamber, when the device is activated. If appropriate, one of the films forming the chamber bulges slightly outward as the pressure increasingly builds up.

Preferably, the second chamber is also connected to the dispensing zone via a transition zone that can be selectively opened. This makes easier handling possible. The mixed composition can in this case be dispensed by exerting pressure on the second chamber, without further auxiliary means being necessary for opening the device. Expediently, when the flowable composition is being dispensed, the transition zone to the first chamber is closed by bending it over.

Dispensing zone in the sense of the invention is to be understood here as meaning the zone of the device via which emptying of the mixed composition takes place.

The dispensing zone is preferably shaped in such a way that dependable, uniform dispensing can be ensured.

In this respect, the introduction of flow barriers, as described in DE 19 962 436 A, has proven successful. Barriers of this type ensure that the composition is not spattered when it is dispensed.

By including flow barriers in the dispensing zone, the substance is influenced when it flows out through the dispensing zone in such a way that slow delivery from the dispensing zone is ensured at the mouth of the latter. Consequently, spattering of the substance caused by exerting high pressure on the second chamber when the transition zone suddenly opens is also prevented. The increase in the flow resistance, and consequently the hindering of the outflow of the substance, can be achieved by extending the flow path around the barriers, if appropriate with a change of direction, or by reducing the flow cross section by sealing points or sealing webs arranged in an offset manner.

Furthermore, an increase in the flow resistance can be achieved by a straight constriction of the flow cross section in the dispensing zone. In this case, a restriction by a factor of 1.5 to 5, preferably by a factor of 2, is envisaged. A device of this type is suitable, in particular, whenever low-viscosity substances are to be dispensed without further auxiliary means in a targeted, easy manner without spilling.

Furthermore, the device may have a dispensing zone which is geometrically arranged in such a way in relation to the transition zone that the longitudinal axis of the dispensing zone does not run through the transition zone. In this case, the dispensing zone may have an enlarged volume, in particular, in the part adjoining the transition zone. It is particularly preferred if the dispensing zone is formed as a pocket. In the case of this arrangement, it is advantageous that the substance is conveyed into the dispensing zone by pressure on the substance located in the chamber when the transition zone suddenly opens. In said dispensing zone, the substance experiences a change in direction of the outflow direction as a result of the arrangement of the longitudinal axis of the dispensing zone which does not intersect the transition zone. On account of this change in direction, a slow delivery from the dispensing zone is ensured at the mouth of the latter. If the dispensing zone is formed as a pocket, the substance suddenly flowing out is initially collected in this pocket. Then slow and directed dispensing is possible from this pocket.

To prevent the substances located in the second chamber after the activation of the device from flowing back into the first chamber, it may also be advantageous to fit a valve in the transition zone between the two chambers.

A suitable valve is represented for example by a flexible film (referred to hereafter as valve film), which is fastened in the transition zone between the two chambers, for example to the base film, and protrudes into the second chamber. The first substance can, as already described, be transferred from the first chamber into the second chamber. As soon as the first substance has been transferred completely into the second chamber through the now opened transition zone, the valve film prevents flowing back of the substances located in the second chamber, in that it blocks the transition zone.

Among the advantages provided by this embodiment is that the device does not need to be bent in the transition zone between the two chambers after activation to exclude the possibility of substance flowing back into the first chamber. In the case of this embodiment, it is also not necessary for the films forming the second chamber to be plastically deformable.

For production reasons, it may be advantageous if the valve film additionally lines the first chamber completely or partly and, if appropriate, reaches into the firmly sealed edge zone of the first chamber. In this case, it may be adequate if the valve film adheres on its upper side to the base film only in the transition zone.

The transition zone that can be selectively opened, in combination with the valve film can, for example, also be realized in the following way: the valve film is, for example, connected to the covering film in the area of the first and second chambers and in the transition zone. In the area of the first chamber, in the vicinity of the transition zone that can be selectively opened to the second chamber, the valve film has an opening which has, for example, been punched out from the valve film. The valve film has, furthermore, in the zone of the second chamber a tab or tongue, which can be formed, for example, by punching or cutting out a corresponding shape from the valve film. The residual zone of the valve film detached in the zone of the tab is in this case not removed, but remains in the zone of the second chamber. The valve film is sealed in a peelable manner with the covering film, preferably only in the transition zone.

When the device is activated, the substance is transferred from the first chamber into the second chamber through the opening in the valve film via the transition zone that can be selectively opened, with the tab of the valve film lifting up. As soon as substantially the entire amount of the first substance has been transferred into the second chamber, the tab is pressed against the covering film in the area of the second chamber, or into the existing punched clearance, by the internal pressure building up in the second chamber and pressure relief of the first chamber, and in this way prevents the flowing back of the substance into the first chamber.

In a further embodiment, a third chamber, which is filled with a third substance, may be located in the transition zone that can be selectively opened, between the first chamber and the second chamber. When the device is activated, in this case firstly the third chamber is opened and the first substance emerging from the first chamber is united with the third substance, located in the third chamber, before it finally enters the second chamber, in which the actual mixing operation takes place.

This arrangement is suitable in particular for intensive mixing of identical or different liquids, which are located in the first and second chambers, with for example a powder, which is located in the third chamber lying in between. The third chamber can be flushed through particularly intensively by repeated, alternating exertion of pressure on the first chamber or second chamber and the substances located therein. In this case, a volume reservoir located in the first and/or second chamber is advantageous.

The device is usually a disposable pack (unit dose). The device is suitable for storing and dispensing all substances for which reproducible mixing and apportioning, to a great extent independently of the user, is required.

In particular, the device has proven successful in the area of human and veterinary medicine and in the dental sector.

Substances to be stored are usually liquids, pastes and/or solids. The solids may in this case be in the form of powder, tablets or granules.

The device is preferably suitable for storing, mixing and dispensing compositions chosen from: human and veterinary medicaments, wound cleaning agents, dental products, adhesives, impression materials, paints, in particular, two-pack paints, foods to be stored separately or their constituents.

The device substantially comprises a first base or lower film and a second covering or upper film, which for their part may be formed as multilayer films.

Depending on the embodiment which is chosen to make possible the increase in volume essential for the invention, at least one of the films is plastically deformable, preferably thermoformable while deforming.

Preferably used as films are those which have adequate diffusion impermeability.

Depending on the nature of the substance to be stored, the films should also be resistant to aggressive substances, for example caustic substances and/or substances having the properties of solvents.

Depending on the application area and the desired deformability, the films are stretched or are in an unstretched state before the activation of the device.

The film constituents may be chosen from plastic films, metal foils and ceramic sheets.

Conceivable as plastic films are, for example: PE, PP, PTFE, PET, PA, PBT, PVC, EVA, PVF (polyvinyl fluoride).

Conceivable as metal foils are, for example: Al, Sn, Au, Ag, Fe, Pb.

Ceramic sheets are to be understood as meaning films which have, for example, a layer containing SiOx.

The film may, in principle, be of any desired construction and is based, inter alia, on the nature of the substances to be stored.

A film construction with the sequence from the outside inward of PET, Al, PET, PE or PP, Al, PET, PE, if appropriate also without a PET film as a middle film, has proven to be advantageous.

With the exception of the zones forming the chambers, the films are preferably connected to one another in surface-area contact.

The connection of the first film to the second film may take place, for example, by hot-sealing, cold-sealing, adhesive bonding and/or ultrasonic welding with sonotrodes.

A multilayer construction of the first and second films can be achieved by laminating, calendering, laminating of various layers comprising single films, if appropriate also by vapor-depositing, for example with metals.

To ensure that the substances, which are introduced into the device and can be applied, are protected from incident light, for example, the films are preferably configured in such a way that, in an area surrounding the chamber, they are connected to one another by two spaced-apart sealing seams.

The device can in principle be of any desired form, but is preferably adapted to the nature of the substances stored.

The chambers are preferably formed such that they are round (circular or oval) but, if appropriate, also angular (square, rectangular or triangular).

The transition zone is designed such that, in the storing state, it forms a sealed closure, both between the two chambers and with respect to the zone via which the composition is to be dispensed.

The transition zone that can be selectively opened, or the predetermined breaking point, can be achieved for example by cold-sealing, hot-sealing, ultrasonic welding or adhesive bonding, a different energy input, preferably lower energy input, taking place in the case of hot-sealing in comparison with the other sealing zones. This can be controlled by means of temperature, pressure and/or holding time.

Another possibility is to introduce adhesion-reducing foreign particles, such as punched pieces of peeling film or spots of hot-melt adhesive, between the first film and the second film in the area of the predetermined breaking point. In this case, firmly sealing films are preferably used as the upper and lower films.

The dispensing zone is preferably formed such that it is open toward one side, i.e. in pocket-like, and if appropriate formed such that a dispensing instrument or an applicator can even be introduced in the storing state. The dispensing zone may also serve as an application device itself if there is a correspondingly small diameter of the opening toward the outside, for example in the form of a cannula.

The separation between the chamber or chambers and the dispensing zone is configured with respect to the distance and also with respect to the strength of the adhesive bond such that there is a further predetermined breaking point.

The possibly present application instrument is preferably designed like a brush or a swab. An application instrument with a spherical tip bearing bristles or brush hairs has proven to be favorable. Furthermore, pipettes, cotton sticks, sponges, spatulas or spray heads sealed into the dispensing zone may also be used as an application instrument or as application devices.

Furthermore, it is favorable when using an application instrument if the dispensing zone is to a great extent sealed off from the outside by the application instrument.

A dispensing instrument located in the dispensing zone or only introduced into it at this or a later point in time is wetted when the device is activated and can subsequently be used for applying the released substance.

It is also conceivable for the application instrument to be moved in the direction of the second chamber, in order to release the transition zone that can be selectively opened. This likewise results in the dispensing instrument being wetted.

If repeated application of the released substance is necessary, the application instrument can be re-inserted into the pocket.

The dispensing zone or the application instrument is preferably designed in such a way that, when it is re-inserted, wetting of the outer portion of the application instrument does not take place.

This may happen, for example, by a channel-shaped formation of the dispensing zone and a matching formation of the application instrument.

It is also conceivable for one of the films to be designed in a dish-shaped or well-shaped manner in the dispensing zone, into which the substance is conveyed for repeated wetting of the application instrument without wetting the shaft by squeezing out the chamber in a way similar to in the case of tubes.

The device can be produced, for example, by the following method:

a) provision of a first film,
b) partial thermoforming of the first film, thereby forming two chambers,
c) filling of the two chambers with two substances to be mixed,
d) application of a second film,
e) connecting of the second film to the first film to a great extent in surface-area contact, leaving the chambers free and forming a transition zone that can be selectively opened between the two chambers and in the dispensing zone.

Depending on which embodiment is chosen for the increase in volume of the second chamber, further steps are to be applied.

The first film maybe sealed with the second film only in a peelable manner in the edge zone of the second chamber.

Alternatively, the second film is thermoformed in the area of the second chamber before application (step d)) and subsequently applied with the curvature in the direction of the thermoformed area of the first film from step b) and sealed, with a concave-convex chamber being formed.

Exemplary embodiments of the invention are explained in more detail below on the basis of the drawings. The representations in dashed lines show the device after activation.

DETAILED DESCRIPTION OF THE DRAWINGS

Figure 1:
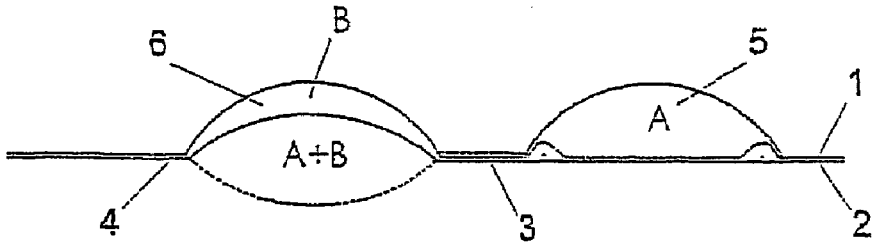
FIG. 1 shows one possible embodiment of the device in cross section.

The device according to FIG. 1 has a base film (1) and a covering film (2). In the area (3), the two films are sealed to each other in a peelable manner, whereby a transition zone that can be selectively opened is formed between the two chambers (5) and (6). In FIG. 1, the dispensing zone (4) also has a transition zone that can be selectively opened. In the chambers (5) and (6) there are two substances (A) and (B) to be mixed. The volume of the second chamber (6) can be enlarged as soon as the device is activated by exerting external pressure on the first chamber (5). In this respect, the base film (1) is curved concavely outward in the zone of the second chamber (6) and the covering film (2) is curved or pre-formed convexly inward.

After activation, the substance (A) from the first chamber (5) is located together with the substance (B) in the second chamber (6). Then, like the base film (1), the covering film (2) likewise has a concavely outward-curved form (dashed line in FIG. 1).

Figure 2:
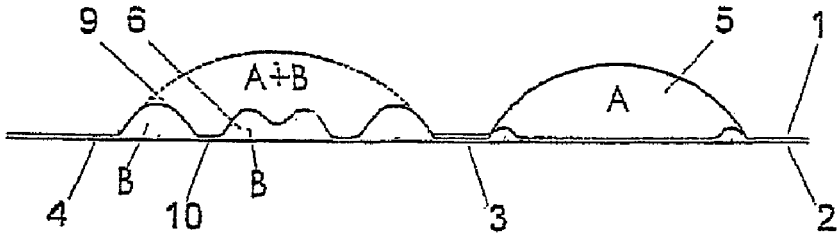
FIG. 2 shows a further embodiment of the device in cross section.

FIG. 2 shows a further possible embodiment for the device in cross section. The increase in volume of the second chamber (5) can be achieved by pre-forming of the base film (1) in the zone of the second chamber (6) with wave peaks (9) and wave valleys (10). Depending on the embodiment, the base film 1 may be sealed in a peelable manner to the covering film (2) not only in the transition zone (3) but additionally at least in the zone of a wave valley (10).

After activation, both substances (A) and (B) are located in the second chamber (6), the volume of which has been increased by bulging of the wave valley (10) into a form which, overall, is to a great extent concave (dashed line in FIG. 2).

Figure 3:
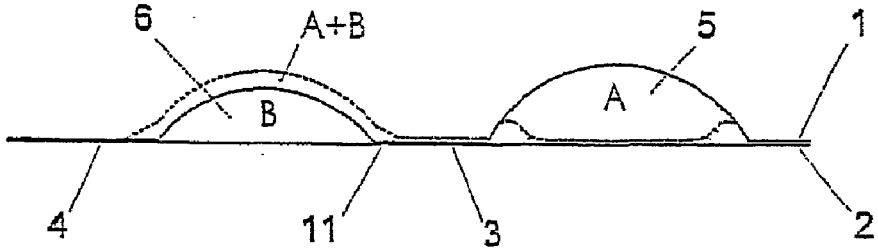
FIG. 3 shows a third possible embodiment of the device in cross section.

FIG. 3 shows a further possible embodiment of the device in cross section. In the edge zone (11) of the second chamber (6), the base film (1) and the covering film (2) are pre-formed such that they can be separated from each other. This pre-forming can be achieved, for example, by peelable sealing of the films in this area or by the film being pressed one onto the other, lying flat, in this area, without being sealed in a peelable manner in this area.

After activation, the base film (1) has been separated or lifted off from the covering film (2) in the edge zone (11) of the second chamber (6) (dashed line in FIG. 3). Both substances (A) and (B) are then located in the second chamber (6). For opening the device, after bending of the device in the transition zone (3) and subsequent exertion of pressure on the second chamber (6), the resistance caused by the transition zone that can be selectively opened is overcome in the dispensing zone.

Figure 4:
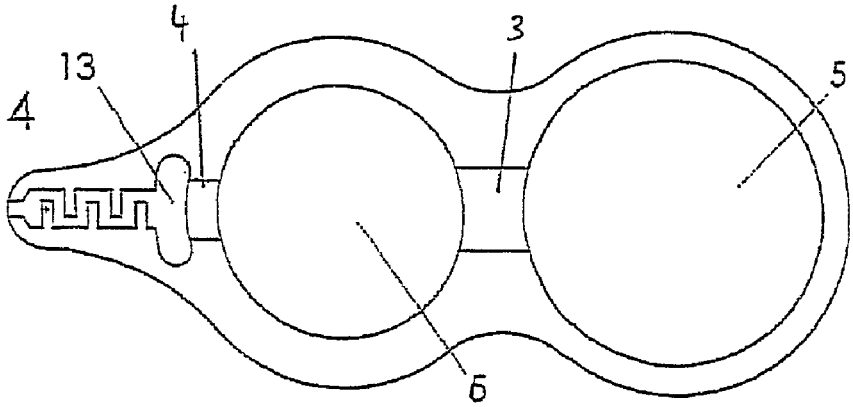
FIG. 4 shows the embodiment according to FIG. 1 in plan view.

FIG. 4 shows the device based on FIG. 1 in plan view. The dispensing zone (4) has flow barriers or is formed in a meandering manner in the dispensing area (13). This prevents spattering when the composition is dispensed from the device.

Figure 5:
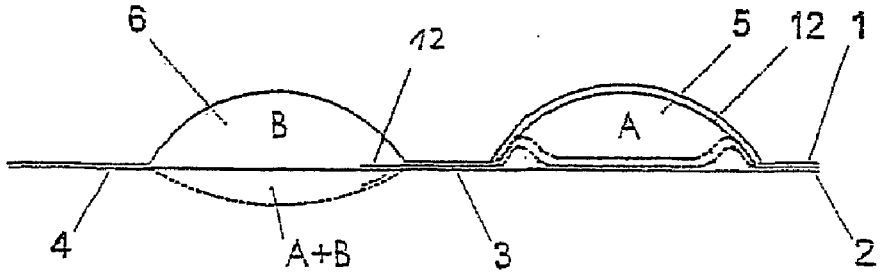
FIG. 5 shows one possible embodiment of the device, including a valve, in cross section.

In FIG. 5, there is in the first chamber (5) and in the transition zone (3) that can be selectively opened a further film (12), which is fastened to the base film (1) and protrudes into the second chamber (6), the film (12) not necessarily being thermoformed in the area of the second chamber. This film (12) performs a valve function, which prevents the substances (A) and (B) that are located in the second chamber (6) after activation of the device from being able to return again into the first chamber (5) when, to dispense the composition comprising the substances (A) and (B), pressure is exerted on the second chamber (6) in order to open the transition zone that can be selectively opened to the outside in the dispensing zone. In this embodiment, the transition zone (3) that can be selectively opened is located between the valve film (12) and the covering film (2).

The dashed representation in FIG. 5 shows the device after activation. The covering film (2) has bulged outward as a result of the built-up internal pressure in the second chamber (6). This deforming of the covering film (2) leads to an increase in volume of the second chamber (6) and makes it possible for the two substances (A) and (B) to be received. The valve film (12) is in this case pressed against the covering film and thereby prevents the mixture from flowing back into the first chamber (5) without the device having to be bent in the transition zone between the two chambers.

Another meaningful application for the device is in the production of packs which can be sterilized, for example by gamma rays or heat. As a result of the pre-forming according to the invention of at least one of the films, the substance or substances stored in the sealed device can be sterilized without any problem by the means mentioned above even if, for example due to the increase in temperature, this causes outgassing of the stored substances, without the device itself being activated or the transition zones that can be selectively opened and that adjoin the chamber or chambers being opened. This type of use may also be employed in the case of devices which have only one chamber for storing a substance.

The invention claimed is:

1. A device, comprising a first and a second film, a dispensing zone, a first chamber, containing a first substance, and a second chamber, containing a second substance, the chambers being connectable to each other via a transition zone that is selectively openable, at least one of the films being thermoformed in an area of the chambers, and at least one of the films having a portion which is deformable in an area of the second chamber in such a way that, after activation of the device, with the transition zone being opened, the first substance is transferable substantially completely into the second chamber, with an increase in volume of said second chamber, without any appreciable flowing back of a mixture into the first chamber occurring;

wherein, said deformable portion comprises a portion of said film which is preformed into a first surface configuration which provides a first volume for said second chamber, and is substantially non-reversibly deformable in response to pressure applied to an interior of the second chamber, to assume a second surface configuration which provides ea second volume for said second chamber, which is greater than said first volume.

2. The device according to claim 1, wherein at least one of the first and second films is concavely-convexly deformed in the area of the second chamber.

3. The device according to claim 1, wherein at least one of the films has in the area of the second chamber a form which is obtainable by at least partially forming a depression into an initially concavely formed surface.

4. The device according to claim 3, wherein the first film is coextensive with the second film at least in an area of said chambers, and is sealed in a peelable manner at a point of contact with said other film.

5. The device according to claim 1, wherein the films forming the chambers are pre-formed such that the films are separable from each other, at least in an edge zone of the second chamber.

6. The device according to claim 1, wherein at least one of the films is expandable in the area of the second chamber.

7. The device according to claim 1, wherein the second chamber is connectable to the dispensing zone via a second transition zone that is selectively openable.

8. The device according to claim 2, wherein the second chamber is connectable to the dispensing zone via a second transition zone that is selectively openable.

9. The device according to claim 3, wherein the second chamber is connectable to the dispensing zone via a second transition zone that is selectively openable.

10. The device according to claim 5, wherein the second chamber is connectable to the dispensing zone via a second transition zone that is selectively openable.

11. The device according to claim 6, wherein the second chamber is connectable to the dispensing zone via a second transition zone that is selectively openable.

12. The device according to claim 1, wherein a third chamber is located between the first chamber and the second chamber in the transition zone that is selectively openable.

13. The device according to claim 2, wherein a third chamber is located between the first chamber and the second chamber in the transition zone that is selectively openable.

14. The device according to claim 5, wherein a third chamber is located between the first chamber and the second chamber in the transition zone that is selectively openable.

15. The device according to claim 6, wherein a third chamber is located between the first chamber and the second chamber in the transition zone that is selectively openable.

16. The device according to claim 1, wherein a third film, which protrudes into the second chamber, is attached to one of the films forming the chambers in the transition zone between the two chambers.

17. The device according to claim 2, wherein a third film, which protrudes into the second chamber, is attached to one of the films forming the chambers in the transition zone between the two chambers.

18. The device according to claim 6, wherein a third film, which protrudes into the second chamber, is attached to one of the films forming the chambers in the transition zone between the two chambers.

19. The device according to claim 7, wherein a third film, which protrudes into the second chamber, is attached to one of the films forming the chambers in the transition zone between the two chambers.

20. The device according to claim 1, wherein the chambers have different volumes before activation.

21. The device according to claim 1, further comprising an applicator.

22. The device according to claim 1, wherein the applicator is located in the dispensing zone.

23. The device according to claim 1, wherein the first substance is flowable and the second substance is solid.

24. The device according to claim 1, wherein flow barriers are located in the dispensing zone.

25. The device according to claim 1, wherein the transition zone that is selectively openable by exposure to a hydrostatic pressure in a range from 3 to 300 $N/cm^2$.

26. A method of using the device according to claim 1, said method comprising:

storing first and second substances in said first and second chamber;

mixing said first substance into said second substance by applying pressure to said first chamber, whereby said first substance flows through said transition zone and enters said second chamber, such that the volume of the second chamber is substantially non-reversibly enlarged to accommodate entry of said first substance; and dispensing said first and second substances from said second chamber via dispensing zone.

27. The method according to claim 26, wherein the flowable compositions are chosen from: human and veterinary medicaments, wound cleaning agents, dental products, adhesives, impression materials, paints, or foods.

28. A method of making a device, comprising: a) providing a first film, b) partially thermoforming the first film, thereby forming two chambers, c) filling the two chambers with two substances to be mixed in use, d) applying a second film, and e) connecting the second film to the first film substantially in surface-area contact, leaving the chambers free and forming a transition zone that is selectively openable between the two chambers;

wherein said second chamber is plastically deformable in response to an application of pressure to an interior thereof; and said plastic deformation causes said second chamber to assume a configuration in which a volume of said second chamber is substantially non-reversibly increased relative to said volume before said plastic deformation.

29. The method according to claim 28, wherein the second film is pre-formed in a convex or wave-shaped manner in an area of the second chamber before applying the second film.

30. The method according to claim 28, wherein a third film is connected to the first film in the transition zone before applying the second film.

31. A dispensing device comprising:

a first film, a second film, a dispensing area, a first chamber containing a first substance, a second chamber containing a second substance being formed by the films, and an openable transition area connecting the chambers, wherein the first film is thermo-formed in an area of the chambers, and at least one of the films is pre-formed or plastically deformable in an area of the second chamber in order to operatively provide a substantially non-reversibly increased volume for the second chamber, whereby said second chamber accepts and retains substantially all of the first substance transferred from the first chamber via the transition area.

32. A device comprising:

a base film and a cover film which are adhered to each other and have first and second chambers formed therebetween;

a first substance contained in said first chamber, and a second substance contained in said second chamber;

a transition zone formed between said dbase film and said cover film, said transition zone extending from said first chamber and said second chamber being selectively openable to provide a fluid flow connection between said first and second chambers;

wherein, said second chamber is substantially non-reversibly deformable in response to pressure applied to an interior thereof, whereby its volume is substantially non-reversibly increased;

said transition zone is openable in response to pressure applied therein by a deformation of said first chamber which decreases its volume and forces substantially all of said first substance to flow through said transition zone and into said second chamber, whereby said volume of the second chamber is increased by substantially irreversible deformation thereof, such that substantially all of said first substance remains in said second chamber after said deformation of said first chamber.

33. The device according to claim 32, wherein:

said base film has first and second substantially concave depressions formed therein, which concave depressions form a first boundary of said first and second chambers;

said cover film forms a second boundary which closes off said first and second chambers; and said cover film has a depression pattern formed therein in a vicinity adjacent said second chamber, which depression pattern permits a substantially non-reversible expansion of said cover film outwardly away from said concave depression of said second chamber.

34. The device according to claim 32, wherein:

said base film has first and second substantially concave depressions formed therein, which concave depressions form a first boundary of said first and second chambers;

said cover film forms a second boundary which closes off said first and second chambers; and said base film is reversibly adhered to said cover film in a peripheral area of said second chamber and is plastically deformable, whereby said dbase film is detachable from said cover film in said peripheral area, such that it is expandable substantially non-reversibly outwardly away from the cover film and the volume of the second chamber is substantially non-reversibly increased, in response to an application of pressure to an interior of aid second chamber.

35. The device according to claim 33, wherein said depression pattern comprises a concave depression in said cover film, which concave depression projects into said concave depression of the base film which founds the second chamber, said concave depression of the said second chamber being plastically deformable to a configuration in which it extends outwardly away from said cover film.

36. The device according to claim 33, wherein said depression pattern comprises a ruffed pattern in said cover film, which ruffed pattern projects into said concave depression of the base film which founds the second chamber, said ruffed pattern of the said second chamber being plastically deformable to a configuration in which it extends outwardly away from said cover film.

* * * * *

UNITED STATES PATENT AND TRADEMARK OFFICE

CERTIFICATE OF CORRECTION

PATENT NO. : 7,097,075 B2
APPLICATION NO. : 10/416544
DATED : August 29, 2006
INVENTOR(S) : Marc Peuker et al.

It is certified that error appears in the above-identified patent and that said Letters Patent is hereby corrected as shown below:

Column 4,
Line 5, delete “advantageous:” and insert in place thereof --advantageous.--.

Column 11,
Line 49, delete “ea” and insert in place thereof --a--.

Column 14,
Line 41, delete “aid” and insert in place thereof --said--.

Signed and Sealed this

Twentieth Day of May, 2008

JON W. DUDAS
*Director of the United States Patent and Trademark Office*